United States Patent [19]

Gatland et al.

[11] 4,159,598

[45] Jul. 3, 1979

[54] DOOR OPERATOR WITH INSTANT REVERSE FEATURE

[75] Inventors: Geoffrey H. Gatland, Walled Lake, Mich.; Kenneth L. Robitaille, Windsor, Canada

[73] Assignee: Vemco Products, Inc., Detroit, Mich.

[21] Appl. No.: 845,289

[22] Filed: Oct. 25, 1977

Related U.S. Application Data

[63] Continuation-in-part of Ser. No. 584,620, Jun. 6, 1975, Pat. No. 4,055,023.

[51] Int. Cl.[2] ..... E05F 15/10

[52] U.S. Cl. ..... 49/28; 318/265

[58] Field of Search ..... 49/26, 27, 28, 139; 151/13, 27, 48–50; 318/265

[56] References Cited

U.S. PATENT DOCUMENTS

| | | | |
|---|---|---|---|
| 1,086,517 | 2/1914 | Eckman | 151/13 X |
| 2,589,480 | 3/1952 | Curtis | 49/139 X |
| 2,998,197 | 8/1961 | Kachergis | 151/49 X |

FOREIGN PATENT DOCUMENTS

| | | | |
|---|---|---|---|
| 855813 | 12/1960 | United Kingdom | 49/26 |
| 1236760 | 6/1971 | United Kingdom | 49/28 |

*Primary Examiner*—Kenneth Downey

*Attorney, Agent, or Firm*—Krass & Young

[57] ABSTRACT

An improved garage door operator of the motor-driven chain-and-sprocket type comprising a molded plastic gear case assembly supporting an output shaft for rotation relative thereto. A molded plastic worm wheel is loosely disposed on the shaft for limited rotation relative thereto and is driven by a reversible electric motor through a worm. Camming surfaces on the worm wheel and a second element which is fixedly disposed on the shaft form a low-torque coupling such that under normal conditions the motor drives the shaft to move the garage door. If the door encounters an obstacle and is unable to move, continued rotation of the motor drives the cam surface of the second element up the cam surface of the wheel so as to axially shift the second element relative to the gear case to trip a reversing switch. A rachet knob projects outside of the gear case permitting manual adjustment of the low-torque coupling.

5 Claims, 8 Drawing Figures

DOOR OPERATOR WITH INSTANT REVERSE FEATURE

REFERENCE TO RELATED APPLICATIONS

This application is a continuation-in-part-of application Ser. No. 584,620, filed June 6, 1975 entitled "Door Operator With Instant Reverse Feature", issued as U.S. Pat. No. 4,055,023 on Oct. 25, 1977.

INTRODUCTION

This invention relates to power operators for garage doors and the like.

BACKGROUND OF THE INVENTION

Power operators for garage doors and the like generally comprise reversible electric motors connected to the garage door by means of a chain and pulley arrangement and provided with suitable controls to stop the motor at predefined limits of door travel. The typical operator comprises a case made out of stamped metal parts which are fastened together with machine screws, nuts and bolts, and the like, a small electric motor, a speed reducer, some kind of clutch, and a chain and sprocket or pulley drive system.

In one prior art system shown in U.S. Pat. No. 2,672,582 the drive motor is caused to be shut-off at the up and down limits of door travel by sensing the fact that the door encounters a mechanical obstacle; e.g., the floor of the garage or the top limit of the door carriage. Motor shut-off is accomplished by means of a camming clutch arrangement on the motor output shaft which shifts a collar axially along the output shaft to trip a shut-off switch. More specifically, this is provided by means of a pair of collars having a ramp-like meshing combination of cam surfaces, one collar being fixed on the output shaft and the other being loosely disposed on the output shaft. When the door encounters a mechanical obstacle, the motor continues to rotate the fixed collar, but the loose collar which is connected to the door begins to slip and the cams cause an axial shift of one collar relative to the other. When the free collar slides away from the fixed collar, a switch is thrown to stop the motor.

There are a number of disadvantages to this prior art system including the fact that clutch arrangement is operative for every half cycle of door travel and thus must be of extremely durable construction to avoid deterioration in an unacceptably short time. Even with a durable clutch, the operation of stopping the door by running it against a mechanical stop at full speed is bound to produce a good deal of wear on the door, the motor, and the various other components of the operator. Perhaps most importantly is the fast that such a device has the capability of trapping a small child under the door until help arrives to restart the motor in the opposite direction.

The feature of obstacle detection is best provided by means for causing an instant reversal of the direction of motor shaft rotation such that the motor does not merely stop, but actually backs away from the obstacle. This approach, however, calls for a mechanism to disarm the instant reverse just before the door reaches bottom so that the ordinary closing function can not produce a reversal.

The invention of the disclosure herein relates to a garage door operator with an obstacle detector of the instant reverse type. Such a system is described in our copending U.S. application Ser. No. 584,620, (U.S. Pat. No. 4,055,023) the present invention being an improvement thereof.

BRIEF SUMMARY OF THE INVENTION

As set forth immediately above, the subject invention relates to improvements in the design and manufacture of garage door operators of the type having a small drive motor and an output shaft from which mechanical power to drive a door is provided. Moreover the invention relates to garage door operators of the type having instant reverse mechanisms including manually adjustable low-torque couplings. As will be hereinafter described in greater detail the preferred embodiment of the invention comprises a number of components which are most advantageously constructed of molded plastic material. For example, the preferred embodiment comprises a molded plastic gear case which provides support for a main drive shaft, a worm gear, and various other parts including elements of the instant reverse mechanism.

Although the invention is described herein as being embodied in an operator having a chain and sprocket drive system it is equally applicable in many respects to screw drive operator systems; i.e., those systems where the operator and the door are interconnected by an elongated screw shaft, the traveler for which comprises a fixed nut which is mechanically connected to the door. As an example, the overload-detecting instant-reverse feature of the invention which comprises first and second cam elements positioned in the drive train so as to produce a limited axial shift of the second cam element under stalled conditions, such axial shift being such as to immediately reverse the motor travel may be used individually in other applications obvious to those skilled in the art as well as in operators of various types. Various other features and advantages will be set forth in the detailed description of the specific embodiment.

DETAILED DESCRIPTION OF THE SPECIFIC EMBODIMENT

A. Power Drive and Instant Reverse

Figure 1:
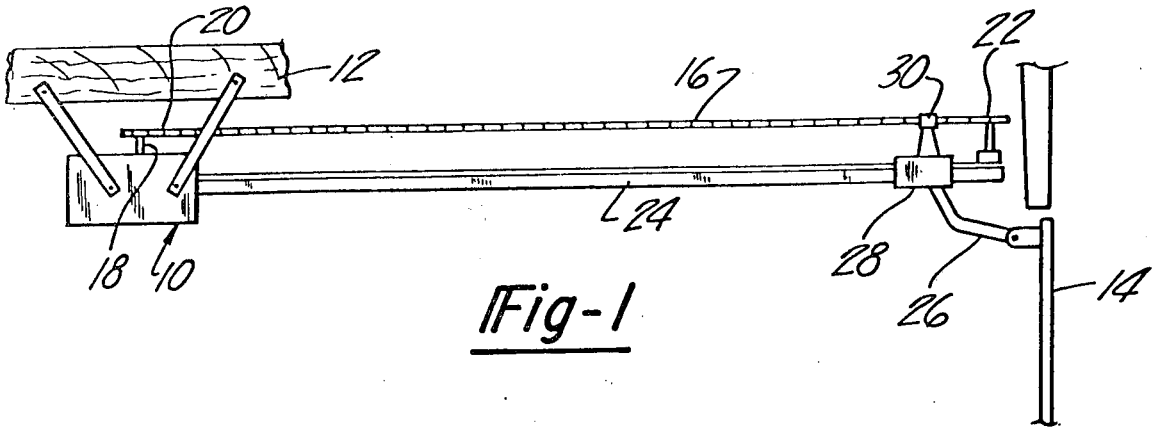
FIG. 1 is a side view of a typical garage door power operator installation.

FIG. 1 shows a typical power garage door operator installation to comprise the power operator 10 suspended from a garage ceiling joist 12 and connected to a pivotal overhead door 14 by way of a drive chain 16. The door is typically mounted in a carriage having up and down limits of travel and is shown in the down limit of travel wherein the bottom edge of the door is adjacent the garage floor (not shown). Chain 16 is engaged with an idler sprocket 22 on rail 24, the chain 16 being connected into a closed loop either by chain links or by a length of substantially inextensible cable.

To produce movement of the door 14 corresponding to movement of the chain 16, a linkage 26 connects the door 14 to a traveler unit 18 which is slidably mounted on the fixed rail 24 extending between the operator 10 and a point immediately adjacent and above the door opening as shown. The traveler 28 is mechanically interconnected with the chain 16 by means of a latch 30 such that traveler 28 moved back-and-forth in a shuttle-like pattern as the operator 10 is actuated in respective half cycles of operation.

FIGS. 2 through 8 illustrate details of the internal mechanism of the operator 10, it being understood that the points of novelty in the subject invention lie in the improved construction of the operator 10 rather than in the overall assembly as has been described with reference to FIG. 1. Moreover, the invention is not dependent upon the specific nature of the drive system or the components thereof such as chain 16, the rail 24, the traveler 28, the linkage 26, the door 14, or any conbination of these devices.

The device of FIGS. 2 through 8 comprise a motor drive operator 10 in which many of the major components, the counterparts of which have heretofore been manufactured from stamped metal, are most expeditiously fabricated from molded plastic. This construction offers considerable reduction in weight, ease of assembly, economy, long life and generally improved operation and user satisfaction. In general, the operator to be described is of the type comprising a rotatable output shaft 18 driven by a motor 50 to raise and lower the door 14 between open and closed limits of travel. It is to be understood that the terms "open", "closed", "up" and "down" are arbitrarily chosen because of the specific embodiment disclosed. However, the term is not intended to limit the applicability of the invention, as sliding doors, gates and various other types of movable appliances may be equally amenable to the application of the subject device. In addition, the operator 10 hereinafter described provides means for sensing the fact that the door has encountered an obstacle beyond which it cannot continue and from which it is necessary to reverse the direction of the door on a substantially instaneous basis.

Figure 2:
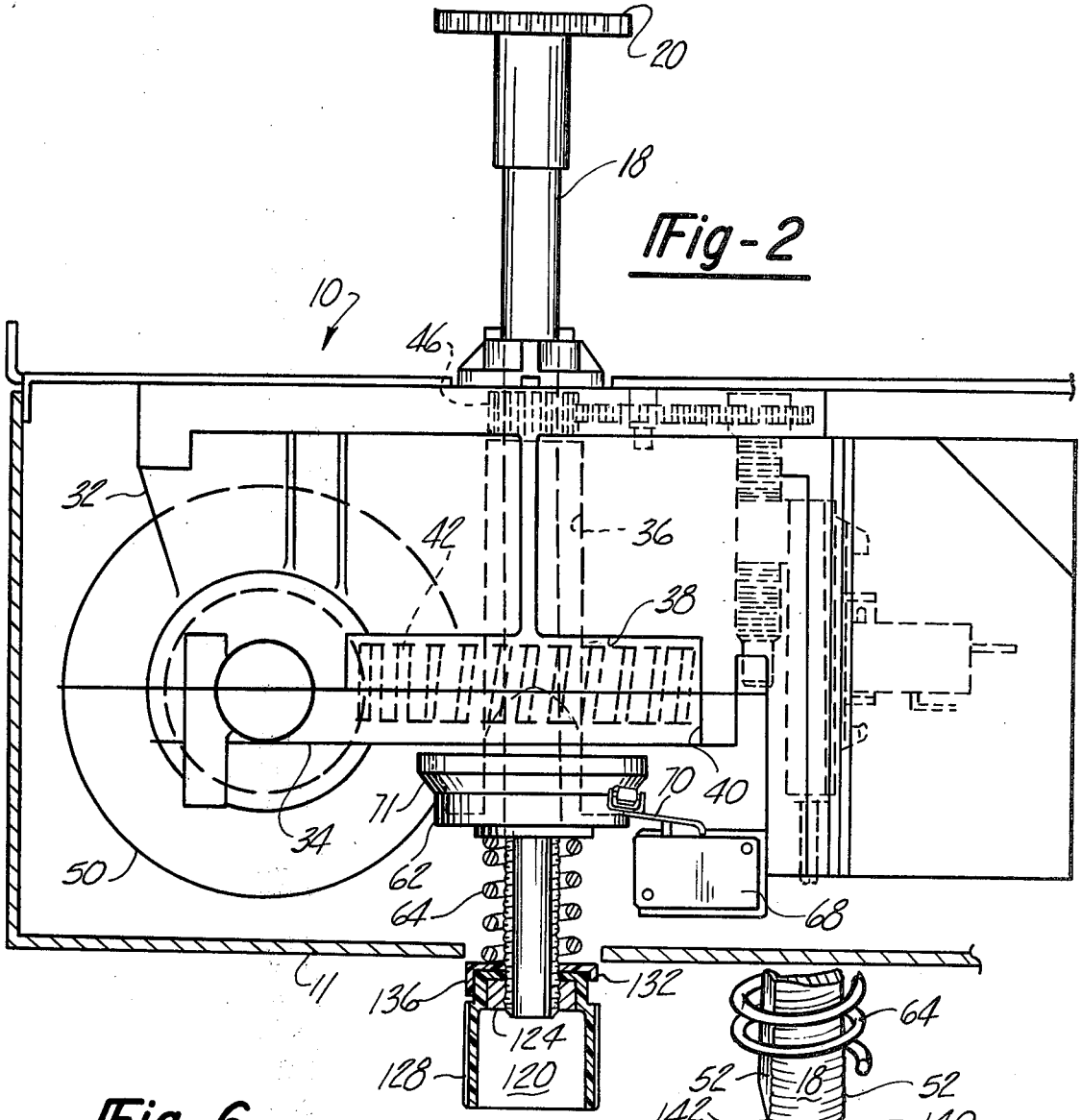
FIG. 2 is a side view, partly in section, of an operator embodying the novel inventive features set forth herein.
Figure 6:
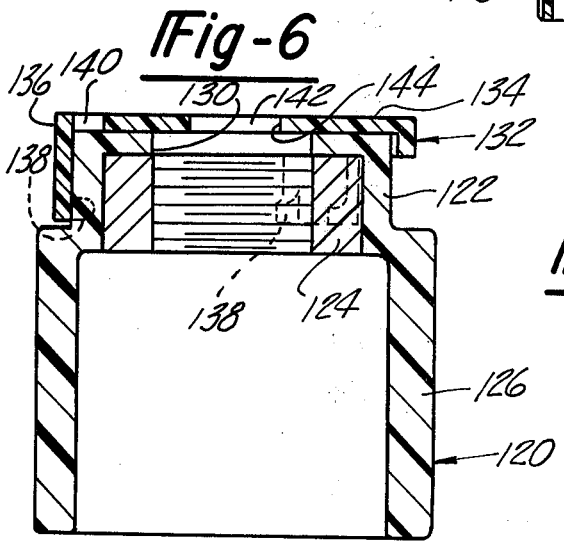
FIG. 6 is a sectional view of a rachet knob assembly used in the assembly of FIG. 2.
Figure 7:
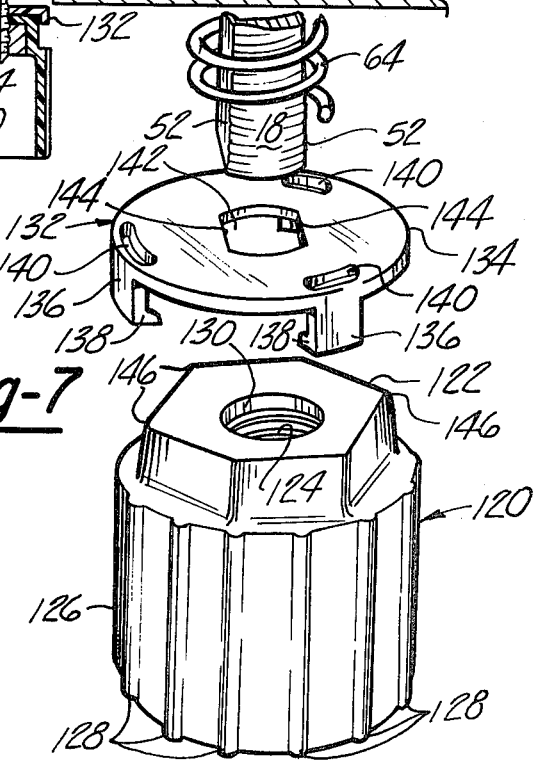
FIG. 7 is a exploded view of the rachet knob assembly.
Figure 8:
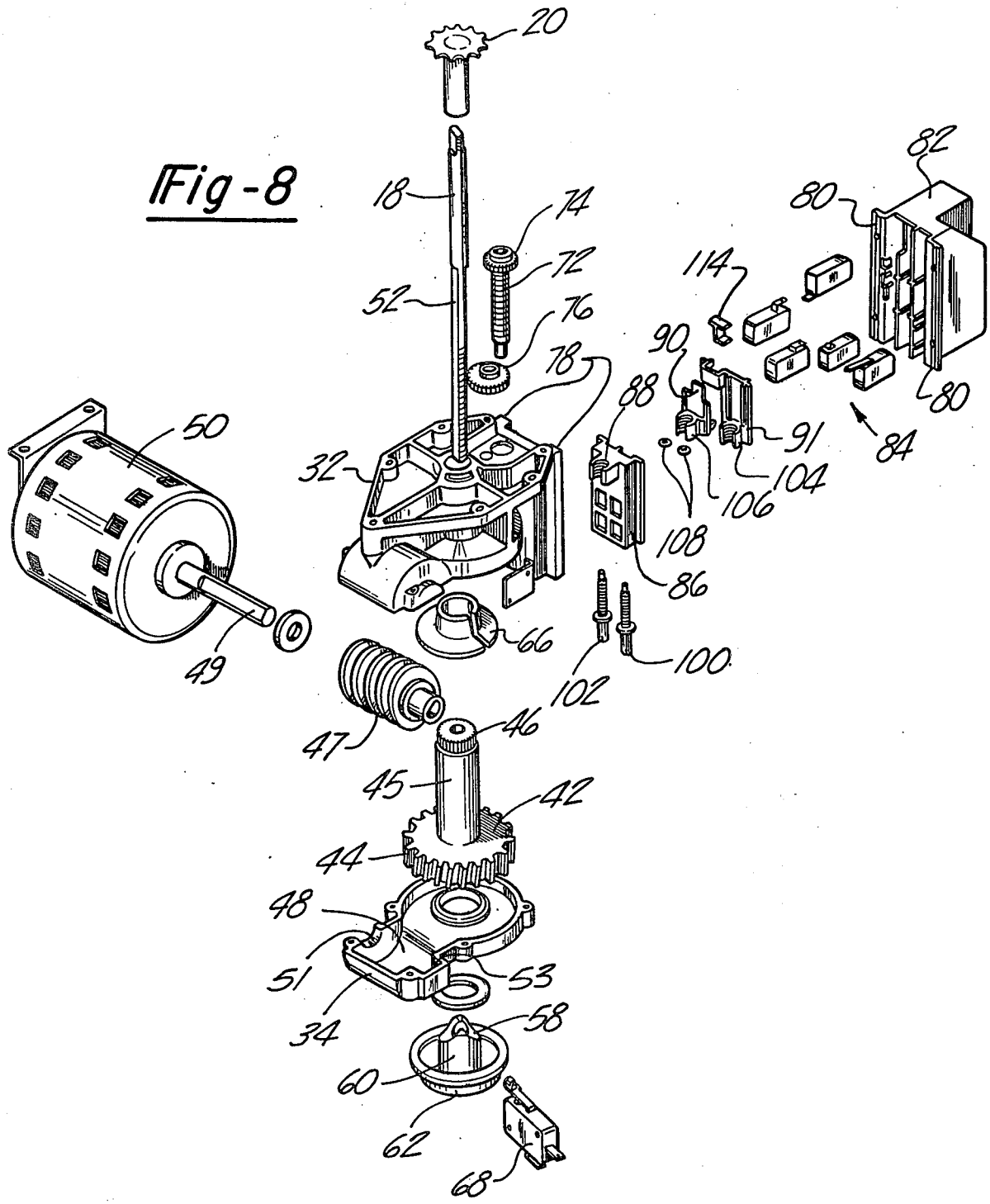
FIG. 8 is an exploded view of the operator of FIG. 2 showing each of the various components of the operator in a partially disassembled state.

Looking to FIGS. 2 and 8 operator 10 comprises a molded plastic body comprising an upper gear case 32 and a lower gear case 34 of complemental configuration and being joined with the upper gear case unit 32 by suitable fasteners such as small screws. The assembled gear case 32, 34 comprises and defines a normally vertically oriented cylindrical cavity 36 defining integrally molded bearing surfaces and extending through the gear case to support the output shaft 18 for rotation therein. The shaft 18 is of steel construction and extends above the gear case body to receive the sprocket 20 as shown, and below the gear case body to receive an adjustment knob 120, the function of which will be hereinafter described. The upper gear case 32 is molded to define a thrust bearing surface 38 which flares outwardly from the inner diameter of the cavity 36 to the wall of a coaxial receptacle cavity 40 which is of increased diameter. Disposed within the two-part interior volume of cavities 36 and 40 is a molded plastic worm wheel 42 comprising a wheel portion having peripheral gear teeth 44 and a hollow shaft portion 45 which terminates at the upper extremity thereof in a drive pinion 46 for purposes to be described. Peripheral teeth 44 of wheel 42 mesh with a worm 47 which is disposed within another interior volume 48 of the gear case 32, 34 also having axially spaced, molded-in bearing surfaces 51 and 53. Worm 47 is mounted for rotation with the output shaft 49 of the drive motor 50. Worm 47 is keyed onto the motor output shaft 49 in the conventional fashion. Accordingly, when motor 50 is actuated, worm gear 47 rotates and produces corresponding rotation of wheel 42.

A split ring bearing collar 66 is preferably disposed about the shaft protion 45 of wheel 42 to reside between the wheel 42 and the thrust bearing surface 38 of the upper gear case 32 to provide a self-lubricating highly efficient bearing. The fact that the ring 66 is split eliminates the need for a high precision injection molding operation.

Figure 4:
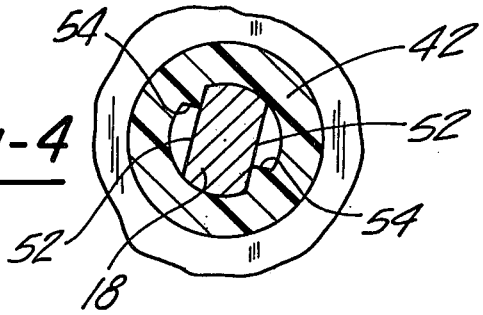
FIG. 4 is a sectional view along section line 4—4 of FIG. 3.
Figure 5:
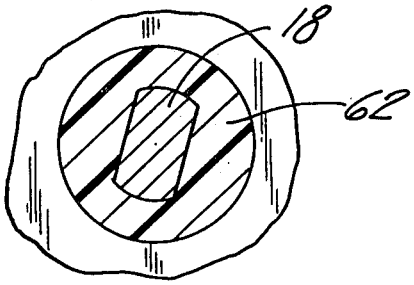
FIG. 5 is a sectional view along section line 5—5 of FIG. 3.

Looking to FIG. 4, the sectional view through the wheel 42, it can be seen that shaft 18 if provided along the lower length thereof with diametrically opposite flats 52 and the interior of the wheel 42, while generally of a cylindrical bore, is provided with radially inwardly projecting nibs 54. In addition, the wheel 42 is loosely (non-drivingly) disposed about the shaft 18 such that there is typically no direct driving connection between wheel 42 and shaft 18, but rather an indirect connection via a molded plastic cam wheel 62 which is fixed on shaft 18 for movement therewith rotationally and free to move on the shaft axially. The low-torque coupling between wheel 42 and wheel 62 provides not only drive power, but a component of an instant-reverse system is hereinafter described.

Figure 3:
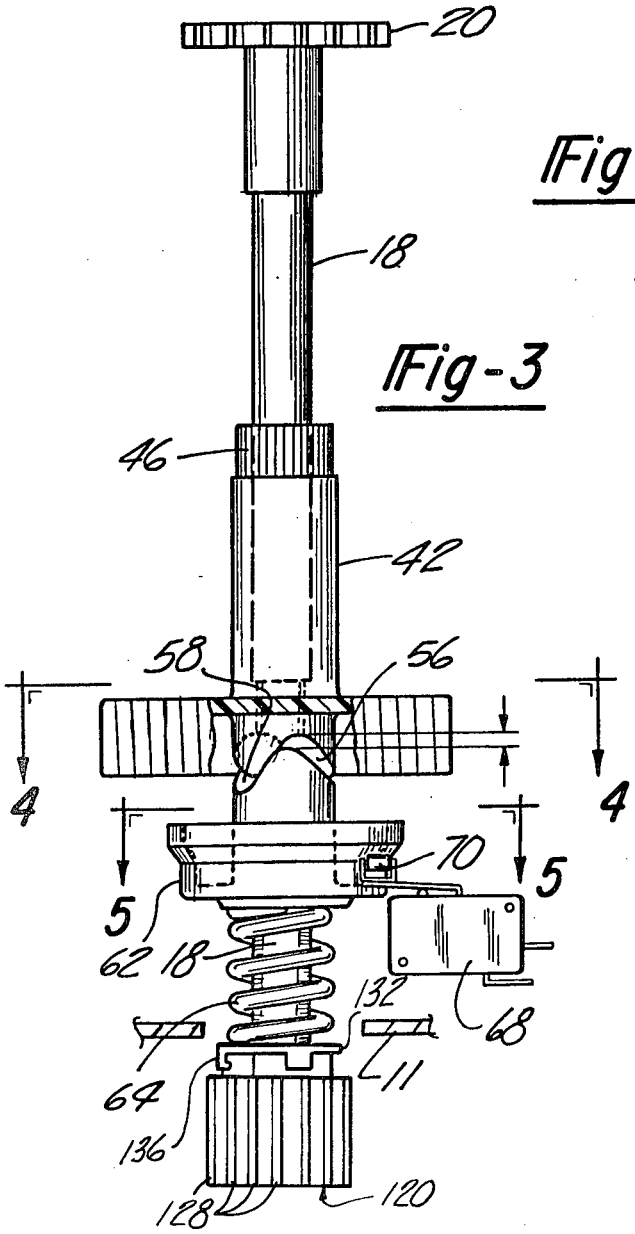
FIG. 3 is a side view, partly in section, of the drive train details of the operator of FIG. 2 in the axially shifted configuration.

Since the wheel 42 is loosely disposed about shaft 18, it is not the primary drive connection between the output shaft 49 of motor 50 and the output shaft 18 of the operator 10. To provide this drive connection, as illustrated in FIG. 3, a low torque coupling is provided in the form of a first axially facing cam surface 56 formed integrally with the wheel 42 and comprising a continuous alternation configuration of lobes and troughs. A second cam surface 58 is provided on the cylindrical portion 60 of the cam wheel 62 which is radially fixedly disposed on the lower end of the shaft 18 to rotate therewith under all conditions. The cam surface 58 on cam wheel 62 is also characterized by a continuous alternating combination of lobes and troughs and thus meshes complementally with the cam surface 56 on wheel 42 to provide a torque coupling with operates in a non-slip mode for all torques below a preset value; i.e., value which is sufficient to move the door in the absence of an obstacle such as an automobile or a human body in the path of the door. However, the torque coupling provided by the meshing cam surfaces 56 and 58 is insufficient to stall the motor 50, in the face of an obstacle, but rather causes relative slip to occur between the motor driven wheel 42 and the cam wheel 60 which is secured on the shaft 18. The nibs 54 limit such slip to about 75°. The actual torque level at which slipage will occur is determined by the setting of the adjustment knob 120 as will be described herein below.

FIG. 2 shows the two cam surfaces under ordinary no-slip conditions while FIG. 3 shows the cam surfaces 56 and 58 after considerable slip has occurred. It will be apparent that the ramp-like configuration of the undulating cam surfaces has caused the cam wheel 62 to move axially away from the gear case body 32, 34. Wheel 42 provides reaction force by pushing against the thrust bearing surface 38 previously described. The cam surfaces 56 and 58 are normally urged into the meshing non-slip configuration by a coil spring 64 which is disposed between the bottom surface of cam wheel 62 and the adjustment knob 120. The adjustment knob 120 is constructed of plastic or the like, having an upper portion 122 configured to nestingly accommodate a steel nut 124 and a lower portion 126 configured to facilitate manual adjustment. An aperture 130 in the upper portion 122 of the knob is coaxial with the nut 124 and allows the knob and nut assembly to threadably engage the lower end of the shaft 18 providing a support surface for the spring 64. As the knob and nut assembly is threaded onto the shaft 18, the spring 64 is compressed, thus further urging the cam surfaces 56 and 58 together and increasing the level of torque required to produce slipage. In application, the torque setting can be adjusted to accommodate varying requirements and system functional characteristics.

A number of vertically oriented ribs 128 are integrally provided on the outermost surface of the lower portion 126 of the knob 120 which project radially outwardly therefrom to facilitate gripping and rotation of the knob 120. The upper portion 122 of the knob 120 has a hexagonal horizontal cross section resulting in six radially outwardly projecting edges 146. A detent ring 132 is located mediate the spring 64 and the uppermost surface of the knob 120 and has a central aperture 142 with two diagonally opposed flats 144 dimensioned to receive the shaft 18. The detent ring 132 will thus rotate with the shaft 18 but is free to slide axially therealong. The ring 132 is constructed of molded plastic or the like and has three integral downwardly projecting arms 136 depending from the outer periphery thereof. Each arm 136 has two horizontally spaced inwardly projecting nibs 138 adjacent the free end thereof. The arms 136 are evenly spaced about the periphery of the ring 132 and embrace the upper portion 122 of the knob 120. When the knob 120 is being rotated or adjusted and as a result is moving with respect to the detent ring 132 the outwardly projecting edges 146 interfere with the nibs 138 depending from the arms 136. As a result, each time an edge 146 passes a nib 138, the arm 136 from which that nib 138 depends is sprung outwardly. When the nib 138 passes, the arm 136 returns to its original position. This spring action is facilitated by three crescent shaped apertures 140 within the detent ring 132 adjacent the arms 136 depending therefrom. In application, the projecting edges 146 on the knob 120 tend to be periodically trapped or straddled by respective sets of nibs 138 at each 60° of rotation as the knob 120 is adjusted. This detent action prevents the adjusting knob from loosening from vibration during normal operation of the operator 10.

Summarizing the drive system, reversible motor 50 drives worm wheel 42 by way of worm 47 meshing with peripheral teeth 44. As worm wheel 42 rotates within the gear case body 32, 34, torque is coupled to the cam wheel 62 by way of the cam surfaces 56 and 58, driving shaft 18. Rotation of output shaft 18 produces linear displacement of the chain 16 and the traveler 28 which is mechanically connected to the door.

This description of operation of course assumes that the door 14 is free to move. If an obstacle prevents the door 14 from moving, shaft 18 is held fixed whereupon motor 50 continues to drive wheel 42 causing the cam surfaces 56 and 58 to slip relative to one another as shown in FIG. 3. Slip between the cam surfaces causes an axial shifting of cam member 62 and reversal of motor 50.

The axial shift of the cam wheel 62 on the shaft 18 triggers an "instant reverse" operation which prevents the door from continuing to bear against an obstacle such as a human being. To accomplish this a limit switch 68 is mounted on the gear case 32, 34 with the actuator arm 70 thereof disposed against an annular collar 71 on the external surface of the cam wheel 62. The first quarter-inch or less of axial shift closes the limit switch 68 triggering the instantaneous reversal of motor 50 by means of the circuit illustrated in FIG. 10 of our copending U.S. application Ser. No. 584,620 (U.S. Pat. No. 4,055,023).

This circuit is well known by way of prior art devices and includes the instant reverse feature as well as limit switches for stopping the motor 50 at the opposite limits of travel. Thus, the axial shift of the cam wheel 62 signifies an overload condition caused by the door 14 encountering an obstacle. The result is to instantly reverse the direction of motor 50 to cause the door 14 to back away from the obstacle and prevent serious injury to persons or things which may be caught under the door.

As is also shown in FIGS. 2 and 3, the slope of the cam lobes is not uniform or symmetrical relative to a centerline of a given lobe but is steeper on the side which provides the reaction force while raising the door. The result is a non-uniform or non-symmetrical torque coupling capability such that a lesser torque causes the slip condition while lowering the door and a higher torque causes the slip condition while raising the door. The reason for this asymmetrical torque coupling capability is that raising the door requires moving the door against its own weight and, moreover, it is far less likely that the door will encounter an obstacle when being raised than when being lowered.

Referring to FIG. 8 the apparatus involved in establishing and adjusting the up and down limits of door travel is illustrated. The gear case body 32 provides a second hollow cylindrical cavity with integral bearing holes to accommodate and support for rotation within the gear case a small threaded shaft 72 having a molded plastic gear 75 secured to the upper end thereof for rotation therewith. When disposed within the gear case 32, 34 in the manner shown in FIG. 2, plastic gear 74 is coupled with the gear 46 formed on the upper end of the worm wheel 42 by means of an idler gear 76. Upper gear case element 32 has formed thereon adjacent the cavity for shaft 72 a pair of space parallel mounting surfaces 78 which are grooved to precisely receive and locate the flanged mounting surfaces 80 of a limit switch carrier body 82. The carrier body 82 houses a plurality of limit switches 84 which provide the various motor control function characteristics.

To operate the limit switches 84 a limit switch actuator traveler 86 having an integral molded plastic partial nut 88 is slidably mounted on the gear case 32 between the mounting surfaces 78. Traveler 86 carries in adjustable relationship thereto molded plastic plates 91 and 90 having dogs projecting toward the limit switch banks to actuate the switches 84 at various linear positions of traveler 86. Dog plate 91 is vertically adjustable relative to the traveler body 86 by means of adjustable screw 100 and dog plate 90 is similarly adjustable by means of screw 102. Both screws 100 and 102 pass through two axially spaces ribs in traveler 86 and are locked in place by a flared flange on the shaft of each screw and a push nut 108 which is forced over the screw shaft end. The threaded shaft is thus exposed between the ribs to receive a snap-on molded plastic partial nut 104 and 106 of the dog plates. A small three-sided plastic element 114 is jam fit between a spring tab formed integrally with the carrier body 82 and a down limit switch 84. The operation and advantages of the apparatus involved in establishing and adjusting the up and down limits of door travel are more fully described in my copending U.S. application Ser. No. 584,620 (U.S. Pat. No. 4,055,023).

It is to be understood that the subject invention may be implemented in various ways and that the foregoing description is not to be construed in a limiting sense.

The embodiment of the invention in which an exclusive property or privilege is claimed are defined as follows:

1. In a door operator, a motor for moving the door between up and down limits; an operator body; an integral drive shaft supported by the body for rotation relative thereto and having opposite ends extending from said body; means on one end of the shaft and operated by said shaft for mechanical connection to the door to move the door as the shaft rotates; a first cam element disposed on the shaft and mechanically keyed thereto for rotation with the shaft and spaced from the operator body; a second cam element rotatably disposed on the shaft for at least limited rotation relative thereto between the first cam element and the operator body and bearing against the operator body; gear means connecting the motor directly to the second cam element independently of said shaft, said first and second cam elements being urged into complemental contact with one another to form a torque coupling between the motor and the shaft capable of transmitting torques to said shaft of less than a preset value and responsive to torques in excess of said value to cause said cam elements to slip relative to one another and to cause axial shift of the first cam element away from the second element and the body; adjustment means rotatably disposed on the other end of the shaft to manually selectively vary said preset value; and means carried by the body responsive to the axial shift of said first element to reverse the direction of operation of said motor, said cam elements each comprising alternating lobes and troughs in axially spatial complemental meshing engagement, said lobes and troughs being configured to permit relative slip between the elements at a lower torque level for rotation in one direction and a higher torque level for rotation in the other direction.

2. Apparatus as defined in claim 1 wherein said adjustment means comprises a ratchet knob assembly projecting outwardly from said operator body.

3. Apparatus as defined in claim 2 wherein said ratchet knob assembly comprises a manually adjustable knob threadably disposed on said shaft and an associated detent ring.

4. Apparatus as defined in claim 3 wherein the knob and detent ring are constructed of a molded plastic material.

5. In a door operator, a motor for moving the door between up and down limits; an operator body; an integral drive shaft supported by the body for rotation relative thereto and having opposite ends extending from said body; means on one end of the shaft and operated by said shaft for mechanical connection to the door to move the door as the shaft rotates; a first cam element disposed on the shaft and mechanically keyed thereto for rotation with the shaft and spaced from the operator body; a second cam element rotatably disposed on the shaft for at least limited rotation relative thereto between the first cam element and the operator body and bearing against the operator body; gear means connecting the motor directly to the second cam element independently of said shaft, said first and second cam elements being urged into complemental contact with one another to form a torque coupling between the motor and the shaft capable of transmitting torques to said shaft of less than a preset value and responsive to torques in excess of said value to cause said cam elements to slip relative to one another and to cause axial shift of the first cam element away from the second element and the body; adjustment means rotatably disposed on the other end of the shaft to manually selectively vary said preset value; and means carried by the body responsive to the axial shift of said first element to reverse the direction of operation of said motor, said adjustment means comprising a a ratchet knob assembly projecting outwardly from said operator body and said knob assembly comprising a manually grippable knob having a substantially cylindrical hollow body defining an interior space, a bore through said body and into said interior space, at least a portion of said interior space being defined by polygonal shaped interior and exterior walls, a nut trapped within said shaped portion of said interior and having the bore of said nut in axial alignment and communication with the bore of said body, said shaft extending through said bore and in threaded engagement with said nut, a detent ring on said shaf and connected thereto for rotation therewith, said detent ring having a plurality of axially extending bur radially compliant detents in engagement with the exterior shapes of said portion to inhibit rotation of said knob relative to said shaft, and a spring disposed between said detent ring and said first cam element for urging said first cam element along said shaft and into engagement with said second cam element.

* * * * *